US006250621B1

(12) United States Patent
Ping

(10) Patent No.: US 6,250,621 B1
(45) Date of Patent: Jun. 26, 2001

(54) CLAMP

(75) Inventor: Qui Jian Ping, Hangzhou (CN)

(73) Assignee: Great Neck Saw Manufacturers, Inc., Mineola, NY (US)

( * ) Notice: Subject to any disclaimer, the term of this patent is extended or adjusted under 35 U.S.C. 154(b) by 0 days.

(21) Appl. No.: 09/518,978

(22) Filed: Mar. 6, 2000

(51) Int. Cl.[7] ..... B25B 1/02
(52) U.S. Cl. ..... 269/181; 269/182; 144/305
(58) Field of Search ..... 269/249, 181, 269/182, 179, 183, 246, 286, 184, 185, 186, 187, 273; 411/437

(56) References Cited

U.S. PATENT DOCUMENTS

| | | | | |
|---|---|---|---|---|
| D. 143,096 | | 12/1945 | Sasgen . | |
| 150,900 | | 5/1874 | Silver et al. . | |
| 1,549,567 | | 8/1925 | Baldwin . | |
| 1,749,491 | | 3/1930 | Kokay . | |
| 2,102,602 | | 12/1937 | Nash . | |
| 2,408,801 | | 10/1946 | Miller . | |
| 2,461,687 | * | 2/1949 | Hopfeld | 173/273 |
| 2,463,263 | | 3/1949 | Gordon . | |
| 2,546,336 | * | 3/1951 | Gibbons | 144/305 |
| 2,636,528 | * | 4/1953 | Golnick | 144/305 |
| 2,644,498 | * | 6/1953 | Malecki | 144/305 |
| 2,671,482 | | 3/1954 | Gordon . | |
| 2,705,983 | | 5/1955 | Guadagna . | |
| 2,947,333 | | 8/1960 | Johnson . | |
| 3,066,931 | | 12/1962 | Beals . | |
| 3,193,277 | | 7/1965 | Nagamori . | |
| 3,599,960 | | 8/1971 | Phillips . | |
| 4,534,547 | | 8/1985 | Cox . | |
| 4,569,510 | | 2/1986 | Haramoto . | |
| 4,582,307 | * | 4/1986 | Wang | 269/182 |
| 5,568,916 | * | 10/1996 | Gibbons et al. | 269/174 |
| 5,850,680 | | 12/1998 | Verrier et al. . | |
| 5,913,509 | | 6/1999 | Price et al. . | |
| 5,941,152 | * | 8/1999 | Kim | 83/464 |
| 6,098,973 | * | 8/2000 | Khachatorian | 269/182 |

* cited by examiner

*Primary Examiner*—Derris H. Banks
*Assistant Examiner*—Daniel Shanley
(74) *Attorney, Agent, or Firm*—Joseph J. Previto

(57) ABSTRACT

A clamp having a first leg, a second lega and a base connecting the first and second leg together. An anvil on the first leg and an opening in the second leg. A threaded bolt having threads extending through the opening. A striker head at one end of the threaded bolt which is opposite to and faces the anvil. A control box in the second leg communicating with the opening. A control block mounted within the control box. The control block having teeth extending therefrom which face the threads in the threaded bolt. A control mechanism is provided for moving the control block from a position in which its teeth engage and mesh with the threads on the threaded bolt to a position in which its teeth are disengaged from the threads on the threaded bolt.

7 Claims, 2 Drawing Sheets

CLAMP

The present invention relates to a clamp and more particularly to an improved clamp for clasping an article between an anvil and a striker head.

BACKGROUND

Clamps usually comprise a "U" or "C" shaped frame having a pair of opposed legs and a base connecting the two legs together. One of the legs has an anvil which faces the other leg. The other leg has a threaded bolt extending through it, one end of which has a striker head which faces the anvil. The threaded bolt is threadably mounted and moveable within the other leg so that the striker head is moved toward and away from the anvil when the threaded bolt is screwed or unscrewed. An article may be clasped between the anvil and the striker head by rotating the threaded bolt in one direction to move the striker head toward the anvil until the article is grasped between the striker head and the anvil. The article is unclasped or released by rotating the threaded bolt in the opposite direction to move the striker head away from the anvil and releasing the article. It is sometimes desirable to have the striker head move quickly toward or away from the anvil to clasp or unclasp the article quickly rather than wait for the striker head to be moved toward or away from the article by threading or unthreading the threaded bolt. While quick clasping and quick release clamps have been used in the past, some of these clamps are expensive to manufacture and complicated to use and do not provide for easy access to the interior of the interior of the quick clasp and quick release control mechanism to correct any malfunction.

OBJECTS

The present invention overcomes these difficulties and has for one of its objects the provision of an improved clamp which can quickly release or clasp an article between the anvil and the striker head.

Another object of the present invention is the provision of an improved clamp which is simple to operate.

Another object of the present invention is the provision of an improved clamp which is inexpensive to maintain and manufacture.

Another object of the present invention is the provision of an improved clamp in which a malfunction of the clasp and unclasp control mechanism can be easily corrected.

Other and further objects of the invention will be obvious upon an understanding of the illustrative embodiment about to be described, or will be indicated in the appended claims and various advantages not referred to herein will occur to one skilled in the art upon employment of the invention in practice.

DRAWINGS

A preferred embodiment of the invention has been chosen for purposes of illustration and description and is shown in the accompanying drawings forming a part of the specification, wherein.

DESCRIPTION

Figure 1:
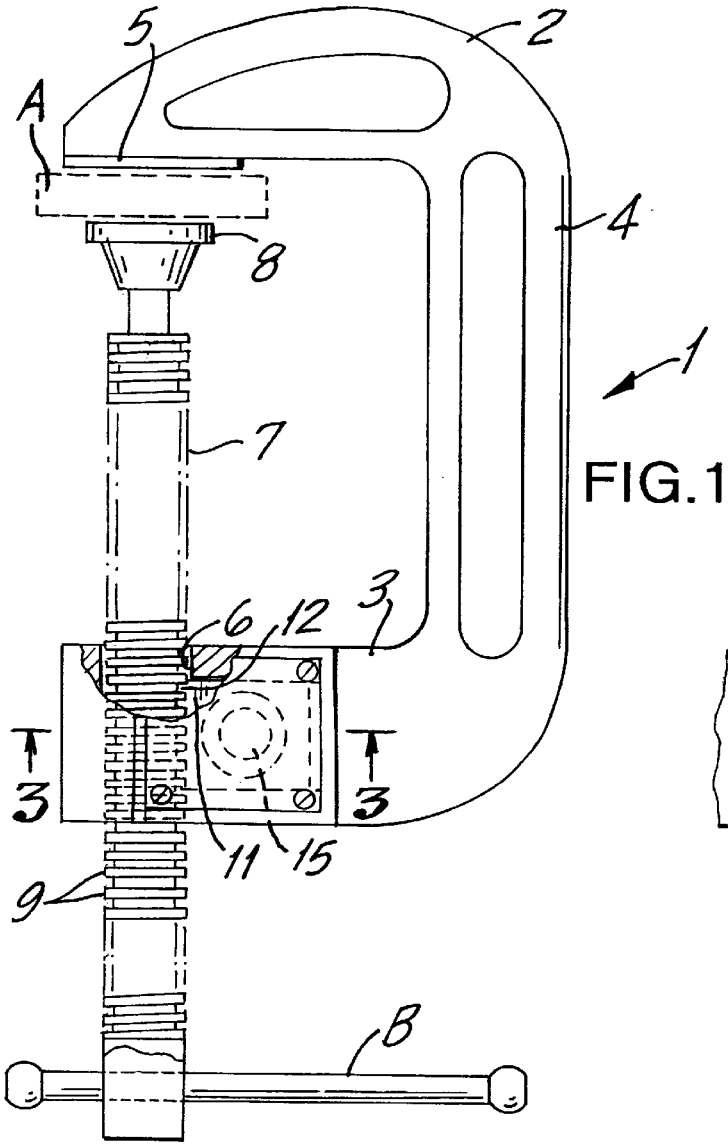
FIG. 1 is a plan view showing one side of the improved clamp of the present invention.
Figure 2:
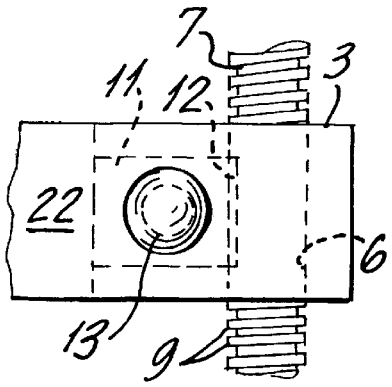
FIG. 2 is a fragmentary plan view showing the other side of the clamp.
Figure 3:
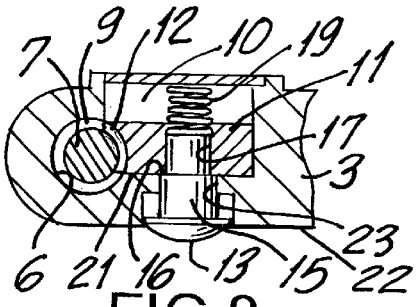
FIG. 3 is a sectional view taken along the line 3—3 of FIG. 1 showing the clamp in its operative position.
Figure 4:
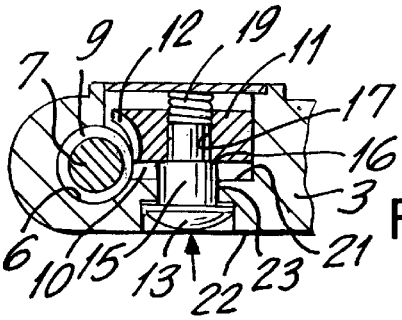
FIG. 4 is a sectional view similar to FIG. 3 showing the clamp in its inoperative position.
Figure 5:
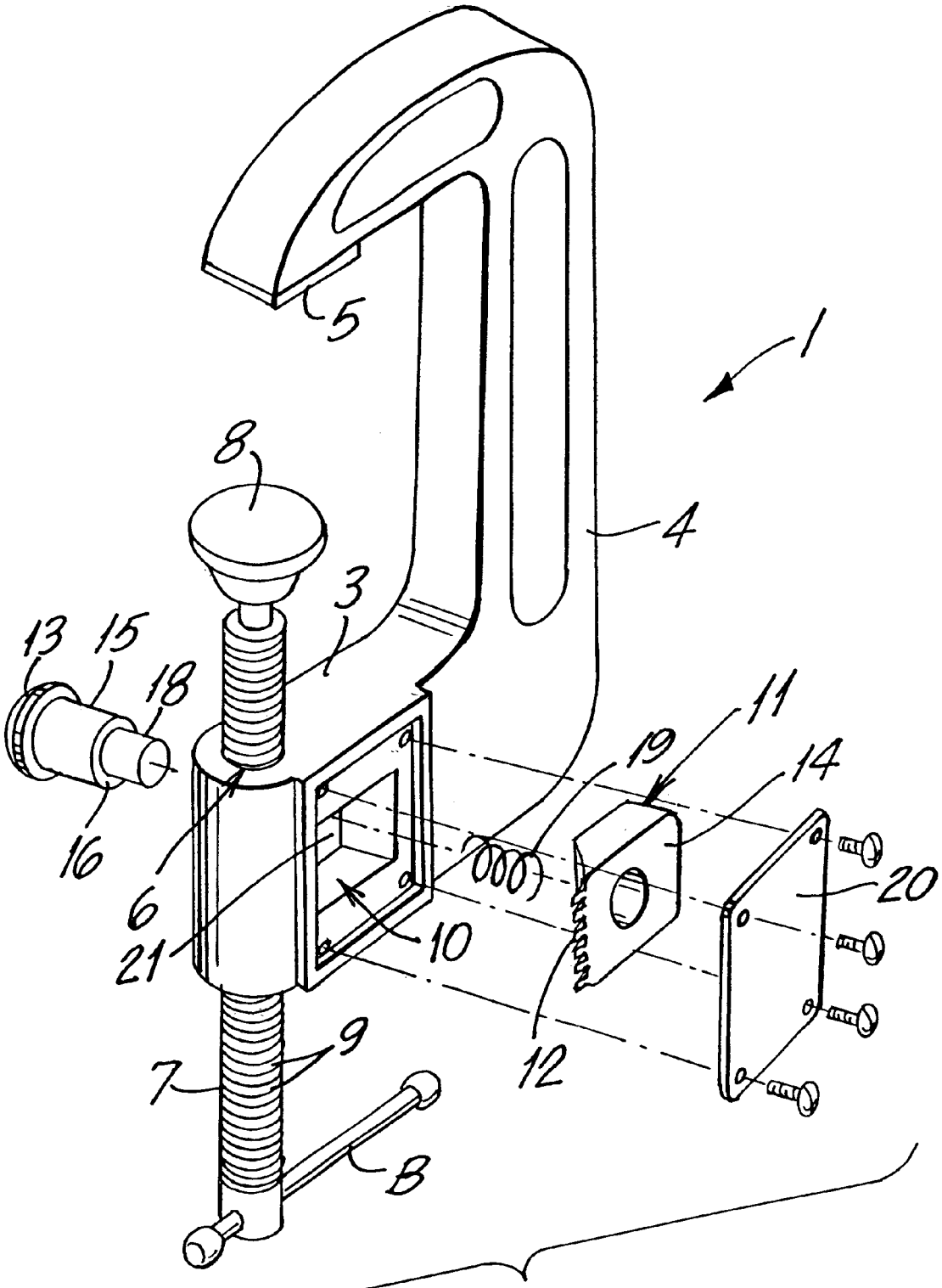
FIG. 5 is a perspective view of the clamp of the present invention.

Referring to the drawings and more particularly to FIG. 1, the clamp 1 of the present invention is "U" or "C" shaped having spaced first and second legs 2 and 3, respectively, connected together by a base 4. The first leg 2 has an anvil 5 which faces the second leg 3. The second leg 3 has an opening 6 therein which is substantially perpendicular to leg 3 and through which extends a threaded bolt 7 having a plurality of threads 9. The upper end of the threaded bolt 7 has a striker head 8 which faces the anvil 5 and the lower end of the threaded bolt 7 has a torque bar B. The opening 6 is not threaded so that the bolt 7 may move freely and quickly within and through the opening 6 in either direction. An article A is adapted to be grasped or clasped between the striker head 8 and the anvil 5 when the threaded bolt 7 is moved in one direction toward the anvil 5 and the article A is adapted to be released or unclasped when the threaded bolt 7 is moved in the opposite direction away from the anvil 5.

The second leg 3 has a control box 10 therein communicating with and extending from the opening 6 in a direction toward the base 4. The control box 10 is shown as preferably being rectangular and adapted to receive a control block 11 which is also preferably rectangular. The control block 11 has a body portion 14 with teeth or threads 12 extending from one end thereof. The threads or teeth 12 are partial threads which are the same size and pitch as the threads 9 on the bolt 7 so that the threads 9 and teeth 12 are able to mesh with each other. The control block 11 lies against an inner wall 21 in the control box 10 and is adapted to be moved toward or away from the inner wall 21. When the control block 11 lies against inner wall 21, its teeth 21 are engaged with and will mesh with the threads 9 on the bolt 7 so that when the bolt 7 is rotated, the bolt 7 will threadably move toward or away from the anvil 4.

The control block 11 may be moved away from the inner wall 21 so that its teeth 12 will become disengaged from and move away from the threads 9 in bolt 7 and the two will no longer mesh with each other. The threaded bolt 7 can now move freely and quickly in and through the opening 6 since its threads 9 no longer mesh with teeth 12 on control block 11. This permits quick release or quick clasp of the item A between the anvil 4 and the striker head 8. Hence, it is not necessary to wait for the slower clasping and unclasping process when the bolt 7 is threadably rotating it to bring the striker head 8 toward and away from the anvil 5.

A control bolt 15 extends from an outer wall 22 of the second leg 3 into the control box 10 through a hole 23 in inner wall 21 (which is opposite to outer wall 22) and into an opening 17 in the control block 11. The control block 11 rests on a shoulder 16 on the control bolt 15. The forward portion 18 of the control bolt 15 extends into the opening 17 in the control block 16. A spring 19 is mounted on the forward end 18 of the control bolt 15 and is held between the forward end 18 and a cover plate 20 which is removably mounted to cover the control box 10 and hold all the parts within the control box 10. The opposite end of the control bolt 15 comprises a button 13 extending through outer wall 22 and adapted to be manually pushed inwardly.

Normally the spring 19 moves the control bolt 15 and its control block 11 toward the inner wall 21 so that its teeth 12 engage and mesh with the threads 9 in the threaded bolt 7.

In this position the threaded bolt 7 may be rotated in one direction or the other to move the striker head 8 slowly toward or away from the anvil 5. However, when quick release or quick clasping is desired, the button 13 is manually pushed inwardly to move the control block 11 away from the inner wall 21 against the pressure of the spring 19 and to disengage and move the teeth 12 away from the threads 9 in the bolt 7. In this position the bolt 7 can move freely and quickly through the opening 6 toward anvil 5 so that its striker head 8 can clasp or unclasp an article A quickly. As soon as the article A is clasped, the control button 13 is released so that an the spring 19 moves the control block 11 against the inner wall 21 so that its teeth 12 now engage and mesh with the threads 9 in threaded bolt 7 to permit rotation of threaded bolt 7 to tighten the striker head 8 on the article A and hold it in place. When it is desired to unclasp the article A, the control button 13 is again pushed in to move the teeth 12 on the control block 11 away form the threads 9 on the threaded bolt 7 thereby permitting the bolt 7 to move freely and quickly away from the anvil 5 to quickly unclasp or release the article A.

The cover plate 20 is removably mounted on the leg 3 over the control box 10 to keep all the control mechanism parts within the control box 10. However, if there is a malfunction within the control box, the cover plate 20 can be easily removed to permit access to the interior of the control box 10 so that the malfunction may be corrected.

It will thus be seen that the present in provides an improved clamp which can quickly release or clasp an article between the anvil and the striker head, which is simple to operate, which is inexpensive to maintain and manufacture and which provide easy access to the control mechanisms to permit malfunctions to be corrected.

As many and varied modifications of the subject matter of this invention will become apparent to those skilled in the art from the detailed description giver hereinabove, it will be understood that the present invention is limited only as provided in the claims appended hereto.

The embodiments of the invention in which an executive property or privilege is claimed are provided as follows:

1. A clamp comprising a first leg and a second leg, a base connecting the first and second legs together, an anvil on the first leg, an opening in the second leg, a threaded bolt having threads thereon extending through said opening, a striker head at one end of said threaded bolt, said striker head being opposite to and facing said anvil, a control box in said second leg communicating with said opening, said control box having an inner wall and a cover plate opposite said inner wall, a control block mounted within said control box, said control block having teeth extended therefrom, said teeth facing the threads in said threaded bolt, control means for moving the control block from a position adjacent said inner wall in which said teeth engage and mesh with the threads on said threaded bolt, said second leg having an outer wall opposite said inner wall, said control block having an opening therein, said control means comprises a control bolt having an inner end and an outer end, said control bolt extends through an opening in the outer wall in said second leg and said inner end extends through said opening and control block.

2. A clamp as said forth in claim 1, wherein means are provided within the control box for biasing the control block against said inner wall.

3. A clamp as said forth in claim 2, wherein spring means are provided within said control box to bias the control block to a position adjacent the said inner wall.

4. A clamp as said forth in claim 3, wherein said spring means are mounted between said control block and said cover plate.

5. A clamp as said forth in claim 4, wherein said spring means is mounted between the inner end of said control bolt and said cover plate.

6. A clamp as said forth in claim 5 wherein the outer end of the control bolt is movable inwardly to move the control block away from the inner wall of the control box.

7. A clamp as said forth in claim 6, wherein said cover plate is removably mounted over said control box.

* * * * *